US011131451B1

(12) United States Patent
Zhang

(10) Patent No.: US 11,131,451 B1
(45) Date of Patent: Sep. 28, 2021

(54) WATERPROOF PLASTIC LAMP AND LAMP STRING

(71) Applicant: C.E.T.Company Limited, Jiaxing (CN)

(72) Inventor: Hui Zhang, Jiaxing (CN)

(73) Assignee: C.E.T. COMPANY LIMITED, Jiaxing (CN)

( * ) Notice: Subject to any disclaimer, the term of this patent is extended or adjusted under 35 U.S.C. 154(b) by 0 days.

(21) Appl. No.: 17/136,711

(22) Filed: Dec. 29, 2020

(30) Foreign Application Priority Data

Nov. 10, 2020 (CN) ..... 202022575789.7

(51) Int. Cl.
*F21V 31/00* (2006.01)
*F21S 4/10* (2016.01)
*F21V 23/06* (2006.01)

(52) U.S. Cl.
CPC ..... *F21V 31/005* (2013.01); *F21S 4/10* (2016.01); *F21V 23/06* (2013.01)

(58) Field of Classification Search
CPC ..... F21V 31/005; F21V 23/06; F21S 4/10
USPC ..... 362/362
See application file for complete search history.

(56) References Cited

U.S. PATENT DOCUMENTS 9,557,019 B2 * 1/2017 Mahr ..... F21V 23/001
10,887,961 B2 * 1/2021 Yu ..... H01R 12/714
2005/0248948 A1 * 11/2005 McCarthy, III ..... F21V 15/02 362/362
2009/0231863 A1 * 9/2009 Johnson ..... F21V 21/08 362/370
2013/0201658 A1 * 8/2013 Bogart ..... F21V 3/062 362/95
2016/0061432 A1 * 3/2016 Bogart ..... F21S 4/10 315/201
2017/0227209 A1 * 8/2017 Slabek ..... F21V 17/12
2017/0307204 A1 * 10/2017 Cattoni ..... F21V 25/12
2018/0017243 A1 * 1/2018 Palmer ..... F21K 9/20
2018/0372278 A1 * 12/2018 Zhang ..... F21K 9/232

* cited by examiner

*Primary Examiner* — Bryon T Gyllstrom
(74) *Attorney, Agent, or Firm* — Bayramoglu Law Offices LLC

(57) ABSTRACT

A waterproof plastic lamp, includes a waterproof plastic bulb and a lamp base, wherein the waterproof plastic bulb comprises a bracket, a lampshade, a luminous body and a conductive plug, the luminous body and the conductive plug are fixedly installed on the bracket, the conductive plug is electrically connected with the luminous body through a guide wire, the bracket is hermetically and fixedly connected to an opening of the lampshade, and the luminous body is sealed inside the lampshade; and the lamp base comprises a lamp holder and a conductive socket, a conductive wire is fixed in the lamp holder, two ends of the conductive wire respectively extend out of the left and right ends of the lamp holder, the conductive socket is electrically connected with the conductive wire, the conductive socket is fixedly connected to the inner side of the lamp holder and is matched with the conductive plug.

19 Claims, 2 Drawing Sheets

WATERPROOF PLASTIC LAMP AND LAMP STRING

CROSS REFERENCE TO THE RELATED APPLICATIONS

This application is based upon and claims priority to Chinese Patent Application No. 202022575789.7, filed on Nov. 10, 2020, the entire contents of which are incorporated herein by reference.

TECHNICAL FIELD

The present invention relates to the technical field of lamps, and particularly relates to a waterproof plastic lamp and a lamp string.

BACKGROUND

Lamp strings are indispensable decorative products for festivals, cultural activities, street scene decoration, and night scene lighting in public places, and are widely applied. A lamp string is composed of a plurality of lamps connected to each other in series or parallel. Lamp strings often need to be used outdoors, so bulbs need to have good waterproof performance.

An easily replaceable lamp and a lamp string structure (Patent No.: CN208204595U) in a Chinese patent includes a lampshade, a lamp tube and a lamp holder, wherein the bottom end of the lamp holder covers the top end of the lampshade, a conductive socket extends downward from the center of the bottom end of the lamp holder, the lamp tube is arranged in the lampshade, and the top end of the lamp tube is detachably connected with the conductive socket. In this kind of lamp, a luminous body is sealed in a protective cover, so that the luminous body has good waterproof performance and is convenient to replace. However, this kind of bulb is complex in structure and difficult to process, and the protective cover also greatly limits the size and shape of the luminous body.

SUMMARY

In order to solve the defects in the prior art, the present invention provides a waterproof plastic lamp and a lamp string.

In order to achieve the above objectives, the present invention adopts the following technical solution:

A waterproof plastic lamp includes a waterproof plastic bulb and a lamp base. The waterproof plastic bulb includes a bracket, a lampshade, a luminous body and a conductive plug, the luminous body and the conductive plug are fixedly installed on the bracket, the conductive plug is electrically connected with the luminous body through a guide wire, the bracket is hermetically and fixedly connected to an opening of the lampshade, and the luminous body is sealed inside the lampshade. The lamp base includes a lamp holder and a conductive socket, a conductive wire is fixed in the lamp holder, two ends of the conductive wire respectively extend out of the left and right ends of the lamp holder, the conductive socket is electrically connected with the conductive wire, the conductive socket is fixedly connected to the inner side of the lamp holder and is matched with the conductive plug; and the conductive plug is inserted into the conductive socket.

Preferably, the outer side of the conductive plug is provided with a connecting groove matched with the conductive socket around the conductive plug, and the end of the conductive socket is inserted into the connecting groove.

Preferably, a waterproof ring is arranged inside the connecting groove, and the end of the conductive socket is closely fitted with the waterproof ring.

Preferably, a core insert electrically connected with the conductive wire is arranged inside the conductive socket, the core insert is electrically connected with the conductive wire, the conductive plug is provided with a jack matched with the core insert, the inner wall of the jack is connected with an elastic sheet, the core insert extends into the jack, and the outer wall of the core insert abuts against the elastic sheet.

Preferably, the outer side of the bracket is hermetically connected with the opening of the lampshade by glue or ultrasonic welding.

Preferably, a lampshade connecting part located outside the conductive socket extends downward from the bottom surface of the lamp holder, the lampshade is detachably connected to the inside of the lampshade connecting part, the inner side of the lampshade connecting part is provided with internal threads, the outer side of the opening of the lampshade is provided with external threads matched with the internal threads, and the lampshade is in threaded connection with the lampshade connecting part.

Preferably, the luminous body is a coiled filament surrounding the outer side of the guide wire, "9"-shaped support frames are staggered on the guide wire along the axial direction of the guide wire, and the curved parts of the support frames surround the coiled filament.

Preferably, the top surface of the lamp holder is provided with a hook holder, and the bottom end of a hook is rotationally connected in the hook holder.

A lamp string includes a power wire and a plurality of waterproof plastic lamps according to any one of claims 1 to 8. The conductive wires of the plurality of waterproof plastic lamps are all connected to the power wire, two ends of the power wire are fixedly connected with a positive plug A and a tail plug A respectively, the positive plug A is sleeved with a nut, and the tail plug A is sleeved with a tail cap matched with the tail plug A.

Preferably, the lamp string further includes a controller connecting wire and a controller. Two ends of the controller connecting wire are fixedly connected with a positive plug B and a tail plug B respectively, the controller is connected to the middle part of the controller connecting wire, and the tail plug B and the positive plug A are in plug connection.

The present invention has the following beneficial effects:

1. The waterproof plastic bulb and the lampshade are sealed and fixed, the luminous body is sealed inside the lampshade, water cannot enter the bulb, and a protective cover structure can be omitted, so that the optional size and shape of the luminous body are more diversified.

2. The bracket of the waterproof plastic bulb is provided with the groove, and the waterproof ring is arranged inside the groove, so as to prevent water vapor from entering the conductive socket and reduce the fault of the bulb.

In the figures: 1 denotes bracket body, 2 denotes plug holder, 3 denotes guide wire holder, 4 denotes luminous body, 41 denotes guide wire, 42 denotes coiled filament, 43 denotes support frame, 5 denotes conductive plug, 6 denotes connecting groove, 7 denotes waterproof ring, 8 denotes lampshade connecting part, 9 denotes lampshade, 10 denotes lamp holder, 11 denotes conductive socket, 12 denotes core insert, 13 denotes lampshade connecting part, 14 denotes hook holder, 15 denotes hook, 16 denotes positive plug B, 17 denotes controller connecting wire, 18 denotes controller, 19 denotes tail plug B, 20 denotes positive plug A, 21 denotes nut, 22 denotes power wire, 23 denotes tail plug A, 24 denotes tail cap, and 25 denotes connecting rope.

DETAILED DESCRIPTION OF THE EMBODIMENTS

The technical solutions in the embodiments of the present invention will be clearly and completely described below with reference to the figures in the embodiments of the present invention. It is apparent that the described embodiments are only a part of the embodiments of the present invention, but are not all of the embodiments.

Figure 1:
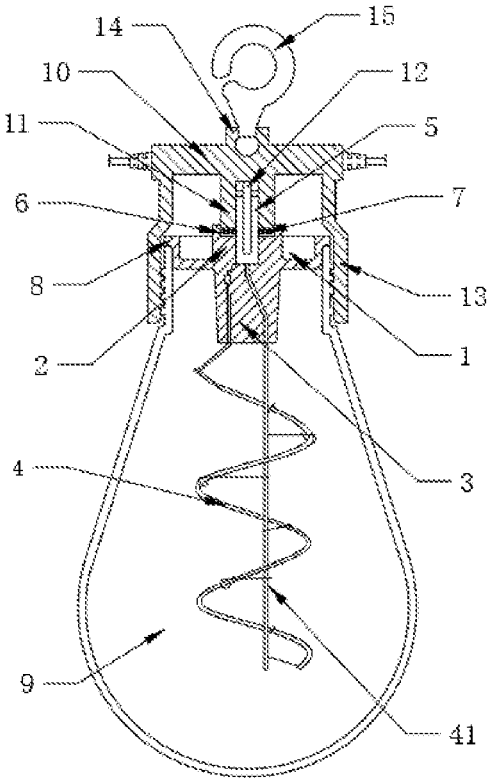
FIG. 1 is a schematic structural diagram of a waterproof plastic lamp provided by the present invention.
Figure 2:
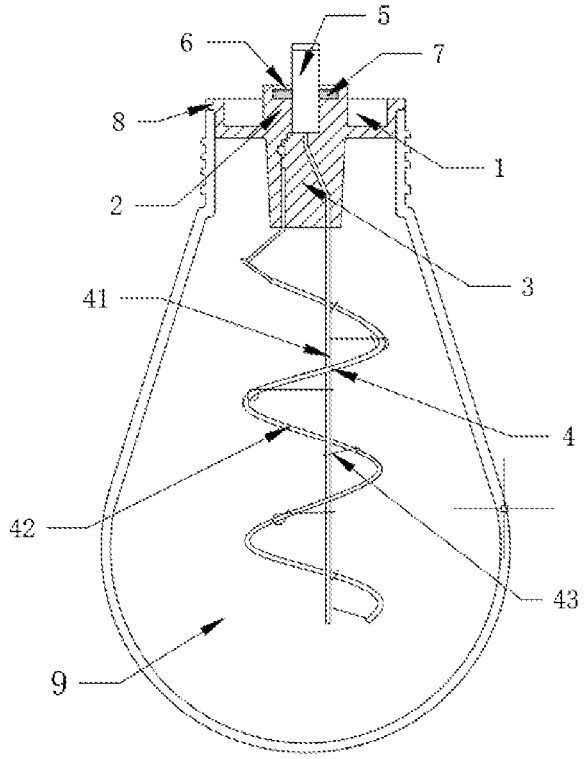
FIG. 2 is a schematic structural diagram of a waterproof plastic bulb of the waterproof plastic lamp provided by the present invention.

Referring to FIGS. 1 and 2, a waterproof plastic lamp includes a waterproof plastic bulb and a lamp base.

The waterproof plastic bulb includes a bracket, a luminous body 4 and a lampshade 9. The bracket includes a bracket body 1. The upper side of the bracket body 1 is provided with a plug holder 2 protruding upward. A conductive plug 5 is fixedly sealed inside the plug holder 2. The upper end of the conductive plug 5 protrudes from the plug holder 2. The conductive plug 5 is welded with a guide wire 41 and is electrically connected with the luminous body 4 through the guide wire 41. The electrodes at both ends of the luminous body 4 are welded to the guide wire 41. The guide wire 41 can be connected in series with or without resistors according to needs, and different resistor colors correspond to different powers. The top end of the conductive plug 5 is also provided with plug plastic, and the color of the plug plastic is matched with the resistor to distinguish the power. The lower side of the bracket body 1 is provided with a guide wire holder 3. The guide wire 41 is first welded to the conductive plug 5, and then the bracket body 1, the plug holder 2 and the guide wire holder 3 are integrally molded by plastic injection. The guide wire 41 is fixedly sealed in the guide wire holder 3 so as to be molded, and then, the electrodes at both ends of the luminous body 4 are welded to the guide wire 41.

In the present embodiment, the luminous body 4 is coiled, the luminous body 4 is a coiled filament 42 surrounding the outer side of the guide wire 41, "9"-shaped support frames 43 are staggered on the guide wire 41 along the axial direction of the guide wire 41, the curved parts of the support frames 43 surround the coiled filament 42, and the support frames 43 are configured to fix the shape of the coiled filament 42 to prevent the coiled filament 42 from being deformed.

In addition, the luminous body 4 may also be ordinary straw hat LEDs, recessed LEDs, LED patch lamp beads, LED copper wire lamps, single straight filaments, double straight filaments, triple straight filaments, and other various shapes of LED luminous bodies according to needs. The single straight filament is a straight filament located on one side of the guide wire 41, and the double straight filaments are two straight filaments symmetrically distributed on two sides of the guide wire 41.

The lampshade 9 is a hollow container with an open top end of any shape and color, which can make the plastic bulb present different shapes and colors.

The bracket is hermetically and fixedly connected to the opening of the lampshade 9, so that the luminous body 4 is sealed inside the lampshade 9, and water cannot enter the lampshade 9. Specifically, the outer side of the bracket is hermetically connected with the opening of the lampshade 9 by glue or ultrasonic welding, the outer side of the bracket body 1 is integrally provided with a lampshade connecting part 8 surrounding the bracket, and the edge of the opening of the lampshade 9 abuts against the lampshade connecting part 8 to enhance the connection stability.

The lamp base is integrally molded by injection, and includes a lamp holder 10 and a conductive socket 11. A conductive wire is fixed in the lamp holder 10, two ends of the conductive wire respectively extend out of the left and right ends of the lamp holder 10. The conductive socket 11 is electrically connected with the conductive wire. The conductive socket 11 is fixedly connected to the inner side of the lamp holder 10 and is matched with the conductive plug 5, and the conductive plug 5 is inserted into the conductive socket 11. A core insert 12 electrically connected with the conductive wire is arranged inside the conductive socket 11. The core insert 12 is electrically connected to the middle part of the conductive wire. The conductive plug 5 is provided with a jack matched with the core insert 12. The inner wall of the jack is connected with an elastic sheet. The core insert 12 extends into the jack, and the outer wall of the core insert 12 abuts against the elastic sheet.

Specifically, when the core insert 12 extends into the jack, the outer wall of the core insert 12 is in contact with the elastic sheet and extrudes the elastic sheet outward. After the plug connection of the core insert 12 and the jack, under the action of the restoring force of the elastic sheet, the core insert 12 is clamped in the conductive plug 5, so as to ensure reliable and stable plug connection.

The upper side of the plug holder 2 is provided with a connecting groove 6 matched with the conductive socket 11 around the conductive plug 5, and the end of the conductive socket 11 is inserted into the connecting groove 6. Further, a waterproof ring 7 is arranged inside the connecting groove 6. After the conductive socket 11 is inserted into the connecting groove 6, the end of the conductive socket 11 is closely fitted with the waterproof ring 7, so as to prevent water vapor from entering the conductive socket 11.

A lampshade connecting part 13 located outside the conductive socket 11 extends downward from the bottom surface of the lamp holder 10, and the lampshade 9 is detachably connected to the inside of the lampshade connecting part 13. Specifically, the inner side of the lampshade connecting part 13 is provided with internal threads, the outer side of the opening of the lampshade 9 is provided with external threads matched with the internal threads, and the lampshade 9 is in threaded connection with the lampshade connecting part 13. The lampshade 9 together with the waterproof plastic bulb can be separated from the lamp base by unscrewing the external threads and the internal threads.

The top surface of the lamp holder 10 is provided with a hook holder 14, the bottom end of a hook 15 is rotationally connected in the hook holder 14, and can be configured to hang a bulb.

Figure 3:
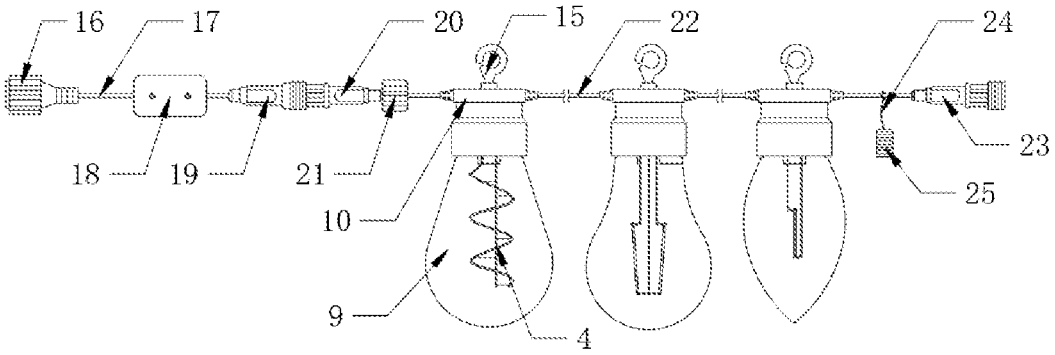
FIG. 3 is a schematic structural diagram of a lamp string provided by the present invention.

Referring to FIG. 3, a lamp string includes a power wire 22 and a plurality of waterproof plastic lamps. The conductive wires of the waterproof plastic lamps are all connected to the power wire 22, and the power wire 22 and the conductive wire are integrally molded. Two ends of the power wire 22 are fixedly connected with a positive plug A 20 and a tail plug A 23 respectively, the positive plug A 20 is sleeved with a nut 21, and the tail plug A 23 is sleeved with a tail cap 24 matched with the tail plug A 23.

Specifically, the plurality of conductive wires are connected to the power wire 22 in series or parallel. The tail cap 24 is hung on the power wire 22 by a connecting rope 25, so as to prevent the tail cap 24 from being lost when the tail cap 24 is detached from the tail plug A 23.

The lamp string may further include a controller connecting wire 17 and a controller 18 for controlling the lighting state of a lamp. Two ends of the controller connecting wire 17 are fixedly connected with a positive plug B 16 and a tail plug B 19 for switching on a power supply respectively, the controller 18 is connected to the middle part of the controller connecting wire 17, and the tail plug B 19 and the positive plug A 20 are in plug connection.

Further, the positive plug A 20 and the positive plug B 16 have the same structure, the tail plug A 23 and the tail plug B 19 have the same structure, and the peripheral side walls of the tail plug A 23 and the tail plug B 19 are provided with threads matched with the nut 21, so as to ensure that the plug connection of the positive plug A 20 or the positive plug B 16 and the tail plug A 23 or the tail plug B 19 is more stable. Therefore, the positive plug A 20 and the tail plug A 23 at two ends of the lamp string are arranged as a set, and a plurality of lamp strings of different shapes and colors can be connected with each other in series or parallel, which is suitable for the arrangement of decorative lamps and is convenient to use. The controller 18 is configured to control the bulb to realize the functions of flicker, constant light, timing, memory, light control, remote control, WIFI, and the like.

The above are only preferred specific embodiments of the present invention, but the scope of protection of the present invention is not limited thereto. Any equivalent replacements or changes made by those skilled in the art within the technical scope disclosed by the present invention according to the technical solutions and concepts of the present invention shall fall within the scope of protection of the present invention.

What is claimed is:

1. A waterproof plastic lamp, comprising a waterproof plastic bulb and a lamp base, wherein the waterproof plastic bulb comprises a bracket, a lampshade, a luminous body and a conductive plug, wherein the luminous body and the conductive plug are fixedly installed on the bracket, the conductive plug is electrically connected with the luminous body through a guide wire, the bracket is hermetically and fixedly connected to an opening of the lampshade, and the luminous body is sealed inside the lampshade; and the lamp base comprises a lamp holder and a conductive socket, a conductive wire is fixed in the lamp holder, two ends of the conductive wire respectively extend out of a left end and a right end of the lamp holder, the conductive socket is electrically connected with the conductive wire, the conductive socket is fixedly connected to an inner side of the lamp holder and the conductive socket is matched with the conductive plug, and the conductive plug is inserted into the conductive socket;

wherein an outer side of the conductive plug is provided with a connecting groove matched with the conductive socket around the conductive plug, and an end of the conductive socket is inserted into the connecting groove.

2. The waterproof plastic lamp according to claim 1, wherein a waterproof ring is arranged inside the connecting groove, and the end of the conductive socket is closely fitted with the waterproof ring.

3. The waterproof plastic lamp according to claim 1, wherein a core insert electrically connected with the conductive wire is arranged inside the conductive socket, the core insert is electrically connected with the conductive wire, the conductive plug is provided with a jack matched with the core insert, an inner wall of the jack is connected to an elastic sheet, the core insert extends into the jack, and an outer wall of the core insert abuts against the elastic sheet.

4. The waterproof plastic lamp according to claim 1, wherein a lampshade connecting part located outside the conductive socket extends downward from a bottom surface of the lamp holder, the lampshade is detachably connected to an inside of the lampshade connecting part, an inner side of the lampshade connecting part is provided with internal threads, an outer side of the opening of the lampshade is provided with external threads matched with the internal threads, and the lampshade is in threaded connection with the lampshade connecting part.

5. The waterproof plastic lamp according to claim 1, wherein the luminous body is a coiled filament surrounding an outer side of the guide wire, "9"-shaped support frames are staggered on the guide wire along an axial direction of the guide wire, and curved parts of the "9"-shaped support frames surround the coiled filament.

6. The waterproof plastic lamp according to claim 1, wherein a top surface of the lamp holder is provided with a hook holder, and a bottom end of a hook is rotationally connected in the hook holder.

7. A waterproof plastic lamp, comprising a waterproof plastic bulb and a lamp base, wherein the waterproof plastic bulb comprises a bracket, a lampshade, a luminous body, and a conductive plug, wherein the luminous body and the conductive plug are fixedly installed on the bracket, the conductive plug is electrically connected with the luminous body through a guide wire, the bracket is hermetically and fixedly connected to an opening of the lampshade, and the luminous body is sealed inside the lampshade; and the lamp base comprises a lamp holder and a conductive socket, a conductive wire is fixed in the lamp holder, two ends of the conductive wire respectively extend out of a left end and a right end of the lamp holder, the conductive socket is electrically connected with the conductive wire, the conductive socket is fixedly connected to an inner side of the lamp holder and the conductive socket is matched with the conductive plug, and the conductive plug is inserted into the conductive socket;

wherein an outer side of the bracket is hermetically connected to the opening of the lampshade by a glue or an ultrasonic welding.

8. A lamp string, comprising a power wire and a plurality of waterproof plastic lamps, wherein conductive wires of the plurality of waterproof plastic lamps are connected to the power wire, two ends of the power wire are fixedly connected to a first positive plug and a first tail plug respectively, the first positive plug is sleeved with a nut, and the first tail plug is sleeved with a tail cap matched with the first tail plug;

wherein each of the plurality of waterproof plastic lamps comprises a waterproof plastic bulb and a lamp base, wherein the waterproof plastic bulb comprises a bracket, a lampshade, a luminous body and a conductive plug, wherein the luminous body and the conductive plug are fixedly installed on the bracket, the conductive plug is electrically connected with the luminous body through a guide wire, the bracket is hermetically and fixedly connected to an opening of the lampshade, and the luminous body is sealed inside the lampshade; and the lamp base comprises a lamp holder and a conductive socket, a conductive wire is fixed in the lamp holder, two ends of the conductive wire respectively extend out of a left end and a right end of the lamp holder, the conductive socket is electrically connected with the conductive wire, the conductive socket is fixedly connected to an inner side of the lamp holder and the conductive socket is matched with the conductive plug, and the conductive plug is inserted into the conductive socket.

9. The lamp string according to claim 8, further comprising a controller connecting wire and a controller, wherein two ends of the controller connecting wire are fixedly connected to a second positive plug and a second tail plug respectively, the controller is connected to a middle part of the controller connecting wire, and the second tail plug and the first positive plug are in a plug connection.

10. The lamp string according to claim 8, wherein an outer side of the conductive plug is provided with a connecting groove matched with the conductive socket around the conductive plug, and an end of the conductive socket is inserted into the connecting groove.

11. The lamp string according to claim 10, wherein a waterproof ring is arranged inside the connecting groove, and the end of the conductive socket is closely fitted with the waterproof ring.

12. The lamp string according to claim 11, further comprising a controller connecting wire and a controller, wherein two ends of the controller connecting wire are fixedly connected to a second positive plug and a second tail plug respectively, the controller is connected to a middle part of the controller connecting wire, and the second tail plug and the first positive plug are in a plug connection.

13. The lamp string according to claim 10, further comprising a controller connecting wire and a controller, wherein two ends of the controller connecting wire are fixedly connected to a second positive plug and a second tail plug respectively, the controller is connected to a middle part of the controller connecting wire, and the second tail plug and the first positive plug are in a plug connection.

14. The lamp string according to claim 8, wherein a core insert electrically connected with the conductive wire is arranged inside the conductive socket, the core insert is electrically connected with the conductive wire, the conductive plug is provided with a jack matched with the core insert, an inner wall of the jack is connected to an elastic sheet, the core insert extends into the jack, and an outer wall of the core insert abuts against the elastic sheet.

15. The lamp string according to claim 14, further comprising a controller connecting wire and a controller, wherein two ends of the controller connecting wire are fixedly connected to a second positive plug and a second tail plug respectively, the controller is connected to a middle part of the controller connecting wire, and the second tail plug and the first positive plug are in a plug connection.

16. The lamp string according to claim 8, wherein an outer side of the bracket is hermetically connected to the opening of the lampshade by a glue or an ultrasonic welding.

17. The lamp string according to claim 8, wherein a lampshade connecting part located outside the conductive socket extends downward from a bottom surface of the lamp holder, the lampshade is detachably connected to an inside of the lampshade connecting part, an inner side of the lampshade connecting part is provided with internal threads, an outer side of the opening of the lampshade is provided with external threads matched with the internal threads, and the lampshade is in threaded connection with the lampshade connecting part.

18. The lamp string according to claim 8, wherein the luminous body is a coiled filament surrounding an outer side of the guide wire, "9"-shaped support frames are staggered on the guide wire along an axial direction of the guide wire, and curved parts of the "9"-shaped support frames surround the coiled filament.

19. The lamp string according to claim 8, wherein a top surface of the lamp holder is provided with a hook holder, and a bottom end of a hook is rotationally connected in the hook holder.

* * * * *